US007992815B2

(12) United States Patent
Bell

(10) Patent No.: US 7,992,815 B2
(45) Date of Patent: Aug. 9, 2011

(54) PULVERIZER MILL YOKE WITH SUPPORTING FRAMEWORK

(76) Inventor: William Graham Bell, Stafford (GB)

( * ) Notice: Subject to any disclaimer, the term of this patent is extended or adjusted under 35 U.S.C. 154(b) by 674 days.

(21) Appl. No.: 11/568,106

(22) PCT Filed: Mar. 17, 2005

(86) PCT No.: PCT/GB2005/001132
§ 371 (c)(1),
(2), (4) Date: Jan. 8, 2008

(87) PCT Pub. No.: WO2005/099902
PCT Pub. Date: Oct. 27, 2005

(65) Prior Publication Data

US 2008/0128575 A1 Jun. 5, 2008

(30) Foreign Application Priority Data

Apr. 19, 2004 (GB) ..... 0408659.1

(51) Int. Cl.
*B02C 15/00* (2006.01)

(52) U.S. Cl. ..... 241/117

(58) Field of Classification Search ..... 241/117–121
See application file for complete search history.

(56) References Cited

U.S. PATENT DOCUMENTS 284,611 A * 9/1883 Case ..... 241/114
4,566,664 A 1/1986 Donald et al.

FOREIGN PATENT DOCUMENTS

FR 1149818 A 1/1958
GB 15959 A 10/1897
GB 1379163 A 1/1975

* cited by examiner

*Primary Examiner* — Faye Francis
(74) *Attorney, Agent, or Firm* — Oliff & Berridge, PLC

(57) ABSTRACT

A pulveriser mill has a grinding set (2) supported by a support table (4), the support table having on its underside supporting parts 8', 10', 12'. By such means the working life of the support table may be extended.

2 Claims, 2 Drawing Sheets

PULVERIZER MILL YOKE WITH SUPPORTING FRAMEWORK

This invention relates to industrial apparatus, namely a mill, in which pieces of a material are pulverised into a particulate form. The invention relates particularly, but not exclusively, to a mill in which coal is pulverised into a particulate form which is conveyed to combustion apparatus eg of a power station.

In particular the invention concerns a mill having a grinding ring formed with an annular depression, and grinding elements (for example grinding balls) therein, urged downwardly, to hold them in contact with the grinding ring, by a top part.

In such a mill the grinding ring is a casting and is supported from underneath. In practice the grinding ring rests on the support table; typically a generally horizontal, substantial steel body. Typically the necessary relative movement of the grinding elements and the grinding ring is achieved by driving the assembly of the support table and grinding ring, while the top part is not driven, and the grinding elements are not driven, but are free to precess. In some mills the support table, grinding ring and the top part are each rotated, in opposite directions.

To describe this in a little more detail, the support table is affixed to, or otherwise unitary with, a hub. The hub is rotated, thereby rotating the support table. The support table carries with it the grinding ring. The grinding ring is not rigidly secured to the support table. Rather, it is typically dropped onto it in a simple peg and hole arrangement, which permits the assembly to accommodate the different coefficients of thermal expansion, as between the material of the support table and the material of the grinding ring. This degree of accommodation in the interconnection of the two parts is necessary, but it does have the consequence that there is a slow but inexorable process of wear, at the abutting surfaces of the grinding ring and the support table.

For reasons primarily associated with the wear of the grinding ring at the interface with the grinding elements, the grinding ring is typically changed every 25,000 to 50,000 working hours. The support table, typically, does not need to be changed at this point but its upper surface does need to be skimmed, by a machining operation, to render it smooth again. Typically the opportunity is taken to machine it so that the thickness of the support table can be as much as 3 mm less than when it was commissioned. Then, when the next grinding ring is changed, after a further 25,000 to 50,000 working hours, the upper surface of the support table is again machined so that the total thickness of the support table is then about 6 mm less than it was when it was commissioned; and so on.

In many mills the thickness of the support table when it is commissioned is about 140 mm. When the thickness is reduced to less than about 120-125 mm operational problems may result. In effect the support table is a circular cantilever extending outwards from, and supported by, the central hub. When the thickness reduces it may sag slightly. In the rigorous environment of a pulveriser mill even a small downward deflection at the periphery of the support table can have undesirable consequences. A downwardly deflected support table does not provide good support for the grinding ring, especially the outer region thereof. The consequence can be the fracture of the grinding ring, typically at the base of the annular groove, where the thickness of the grinding ring is usually relatively small.

Therefore at some support table thickness below 120-125 mm—the precise value being the decision of the operator— the support table is removed, and replaced by a new support table. However this is an expensive operation. The support table itself, though only a single piece of simple construction, is costly and the mill down-time has an adverse economic consequence. The aim will be to replace the support table when the grinding ring is replaced, but this may not be possible in all cases.

Typically this problem of support table replacement may arise about 20 years after commissioning of a mill and/or of a support table. Very many pulveriser mills are now entering the phase of their lifetime, when support table replacement must be contemplated.

It would be desirable to provide new support tables with a longer lifetime and/or to be able to extend the lifetime of support tables which are already in use. Aside from the economic benefits referred to above, this could have significant environmental benefits. For example the energy consumed in the manufacture of a new support table is extremely large.

In accordance with a first aspect of the present invention there is provided a mill having a grinding set supported by a support table, the support table having on its underside at least one supporting part.

Preferably the mill is a pulveriser mill, suitably for grinding foraminous materials, such as minerals, and especially coal.

The grinding set suitably comprises a plurality of grinding elements in a grinding ring. The grinding ring and grinding elements move relative to each other. In a typical embodiment the grinding ring is rotatable and the grinding elements are fixed. Preferably the assembly of the grinding ring and support table are co-rotatable. Preferably the support table is mounted on a hub, coupled to a rotating shaft.

The value of such a supporting part is that it allows the support table to be machined down to a lesser thickness than heretofore, without the support table sagging in such a way as to cause operational problems. Preferably it permits the support table to be subjected to at least one further machining operation, preferably to at least two (compared with such a support table without the supporting part).

The supporting part may comprise a bar. The supporting part may comprise a radial bar.

There may be a plurality of bars.

There may be at least 8 radial bars. There may be at least 12 radial bars.

There may be up to 30 radial bars. There may be up to 24 radial bars.

Suitably there may be 16 radial bars.

The supporting part may comprise an annular body, for example a ring or band or hoop. An annular body may be circular in plan or may be polygonal.

There may be an annular body in the region of the hub on which the support table is mounted (hereinafter "inner ring").

There may be an annular body, for example a ring or band, in the region of the periphery of the support table (hereinafter "outer ring").

There may be an array of supporting parts. There may be an outer ring and an inner ring. There may be an outer ring and at least one bar. There may be an inner ring and at least one bar. There may be a plurality of bars. There may be an inner ring, an outer ring and a plurality of bars.

Preferably there is a supporting part which supports the underside of the periphery of the support table, or a plurality of supporting parts which do this.

When there is an array of supporting parts they may suitably be linked together as a framework.

A framework may comprise an outer ring as described above, an array of radial bars, as described above, with each radial bar being secured at its outer end to the outer ring, and preferably an inner ring as described above, each radial bar being secured at its inner end to the inner ring.

The supporting part(s) should be of such material and cross-section as to support the support table effectively against deflection. Preferably the supporting part(s) may have a cross-sectional area of at least 2000 $mm^2$, more preferably at least 4000 $mm^2$. The supporting part(s) may preferably have a cross-sectional area of up to 12000 $mm^2$, more preferably up to 8000 $mm^2$.

Preferably the or each supporting part has a flat face which abuts the underside of the support table. Preferably the or each bar is rectangular in cross-section.

Preferably the or each supporting part is of a material having a substantially similar coefficient of thermal expansion as the support table.

Preferably the or each supporting part is weldable to the support table.

When there are supporting parts in the form of a framework, preferably the framework is formed in situ, on the underside of the support table, by the welding of the individual supporting parts which will form the framework, to each other and to the underside of the support framework. In any practical working situation it is quite possible that some distortion will take place, as a result of the welding operation. Accordingly a final step in the production of the modified support table may be to machine flat its upper surface.

When there are "N" radial bars there may be an outer ring which is circular in plan view or an outer ring which is N-sided, formed by the securement of "N" bars between adjacent outer ends of the radial bars. Likewise, there may be an inner ring which is circular in plan view or an inner ring which is N-sided, formed by securing N bars between the adjacent inner ends of the radial bars.

The support table may be of any shape capable of supporting the grinding ring, and capable of being supported in turn by the supporting part(s) . Preferably its underside, at least where supported directly by the supporting part(s), is flat.

In accordance with a further aspect of the invention there is provided a method of improving a pulveriser mill support table which has been used, comprising the step of providing it on its underside with at least one supporting part as defined and described herein.

In accordance with a further aspect of the invention there is provided a method of grinding piece material into powder material, using a mill of the first aspect.

The invention will now be further described, by way of example, with reference to the accompanying drawings, in which.

As noted above the arrangement shown in FIGS. 1 and 2 is an existing arrangement. In conventional manner, grinding ring 2 rests on a horizontal support table 4 (sometimes called a yoke). The support table 4 is carried in turn by a hub member 6. In the assembled pulveriser mill the hub member 6 is coupled to a rotary driving part, so that the assembly of hub, support table, and grinding ring rotates.

Grinding balls (not shown) are retained between an annular depression 7 formed in the upper surface of the grinding ring and a top part (not shown).

As is described in detail above, wear or "fretting" of the upper surface of the support table 4 takes place over time, and at intervals that surface must be machined. Each time this happens the support table is reduced in thickness by a few millimetres. There comes a time when the support table sags slightly at its periphery, to the extent that the displacement can adversely affect the pulverising operation. Accordingly there comes a time when the support table must be replaced.

Figure 1:
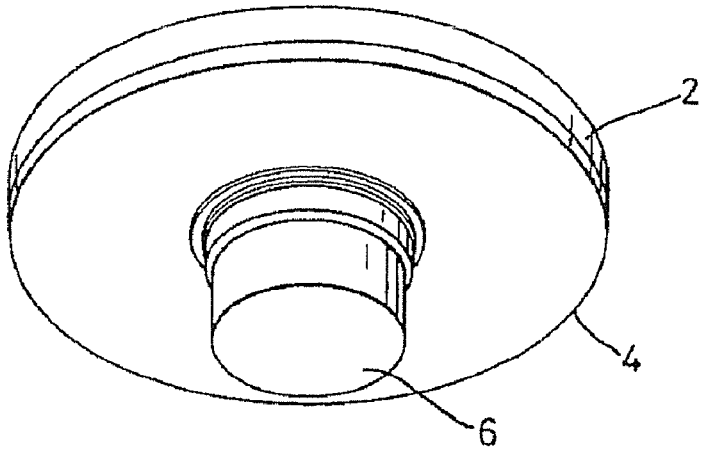
Fig. 1 (Prior Art)
FIG. 1 is a perspective view from underneath of the grinding ring 2 of a pulveriser mill, resting on a support table 4, the arrangement not being in accordance with the invention.
Figure 2:
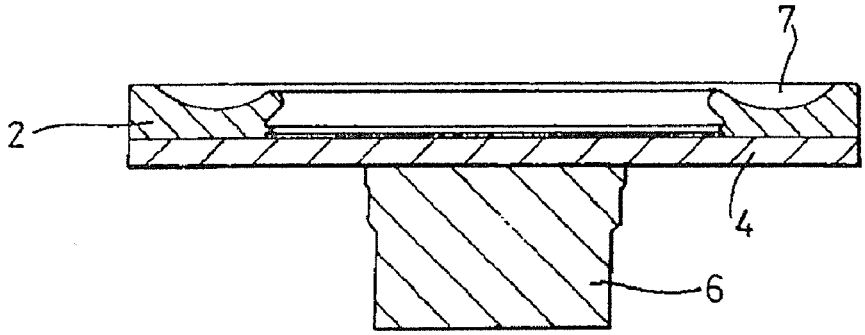
Fig. 2 (Prior Art)
FIG. 2 is a schematic sectional side view of the FIG. 1 structure, the section passing through diametrically opposed radial bars.
Figure 3:
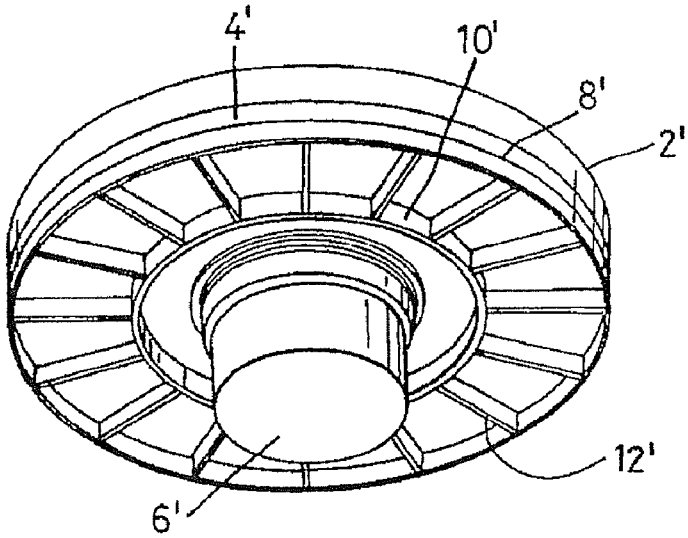
FIG. 3 is a perspective view from underneath corresponding to that of FIG. 1, but in which the support table carries a framework of supporting parts in accordance with the invention.
Figure 4:
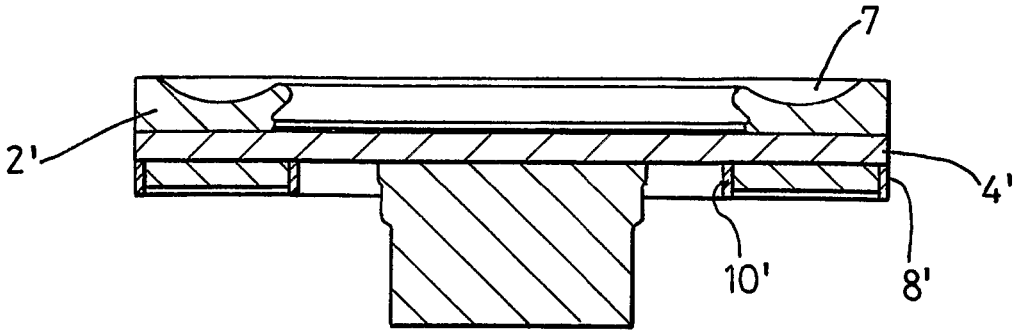
FIG. 4 is a schematic side/sectional view of the FIG. 3 structure.

FIGS. 3 and 4 show an arrangement in accordance with the invention. The same parts as are shown in FIGS. 1 and 2 are shown in FIGS. 3 and 4, marked with the reference numerals 2', 4', 6' and 8'.

The intention of the arrangement shown in FIGS. 3 and 4 is to prevent or reduce this effect.

Accordingly the flat underside of the support table 4', between the hub 6' and its outer periphery, has secured to it a framework of supporting parts. This framework comprises an outer annular (circular in plan view) band 8', ("outer ring") aligned with the periphery of the support table, and an inner annular (circular in plan view) band 10' ("inner ring"), located in the region of, but spaced from, the hub 6'. This spacing is because, in use, there may be parts around the hub which have to be "designed around". Straight supporting bars 12' extend between the outer and inner rings 8' and 10', the ends of the bars 12' being welded to those respective parts. The bars 12' are arranged in a radial array. The cross-sections of the outer ring, inner ring and bars are rectangular. The cross-section of the outer and inner rings is identical, and slightly larger than the cross-section of the bars.

The bars 8', 10' and 12' are of steel and are welded to the underside of the support table in a conventional manner. It is likely that there will be some distortion arising from the welding operation. At the end, the upper surface of the support table will usually need to be skimmed flat. However if this can be minimised it is valuable. Not only is there less waste of material, and faster procedure, but the thickness of the support table is maximised. The thicker the support table is, the longer its lifetime will be, in addition to the lifetime extension attributable to the supporting framework.

It may be desirable to provide a framework of supporting parts as shown, on a newly-manufactured support table. By such means the expected lifetime of the support table may be longer than it would otherwise be. This is valuable, although, of course, it is an economic advantage, the benefit of which is experienced many years later.

Alternatively a framework of supporting parts may be secured to an existing support table which has worn down, and which is at or approaching the end of its useful working life. The lifetime of the support table may thereby be extended.

Figure 5:
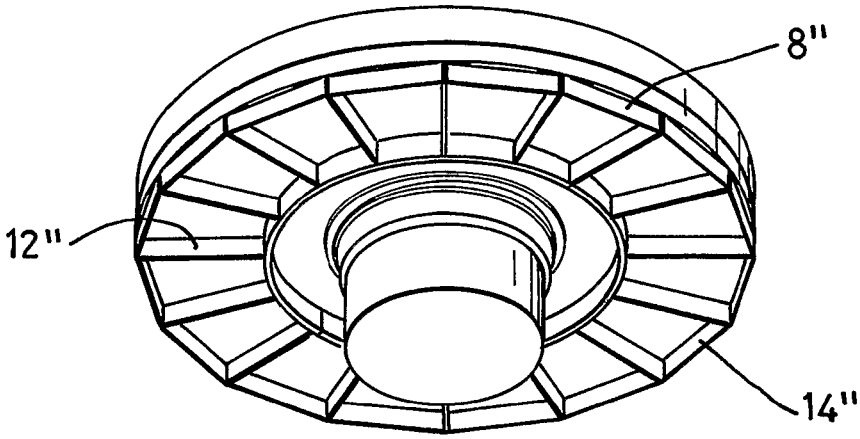
FIG. 5 is a perspective view from underneath of a second embodiment in accordance with the invention.

The embodiment of FIG. 5 differs from the embodiment of FIGS. 3 and 4 only in that the outer ring 8" is not circular in plan view, but polygonal. Straight bars 14" are welded between respective adjacent outer ends of the radial bars 12". Since there are sixteen radial bars (N=16) there are sixteen bars 14" welded between their respective adjacent ends. Accordingly in geometrical terms it may be stated that the outer ring 8" is, in the assembled support framework as shown, a sixteen-sided polygon (a hexadecagon), in plan view.

Figure 6:
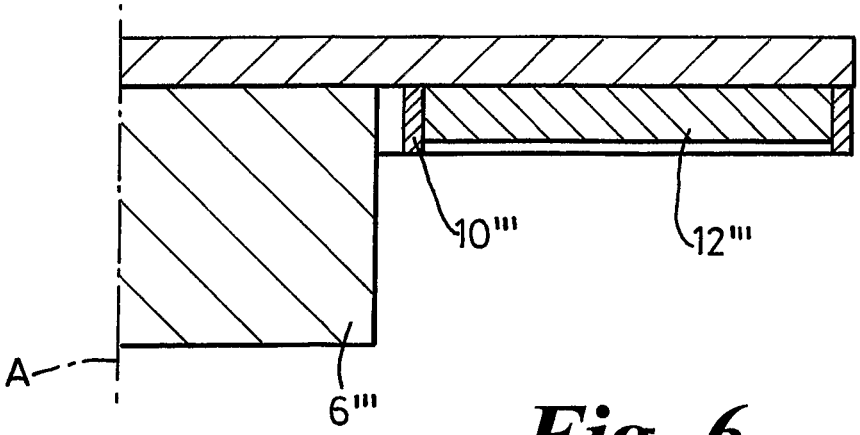
FIG. 6 is a side sectional view of a third embodiment in accordance with the invention, from the centre-line A of the hub to the edge of the support table, and passing through a radial bar.

The embodiment of FIG. 6 differs from that of FIGS. 3 and 4 only in that the inner ring 10" is nearer to the hub 6''', and the bars 12''' correspondingly terminate nearer to the hub. This is simply because the particular pulveriser mill allows this—there are no parts around the hub which would obstruct the framework there.

There are many variations which could be employed. Some of them are referred to above in the passages describing the invention in general terms. For example:

supporting parts could be designed to be bolted together;

supporting parts could be designed to be bolted to the support table;

radial support parts could taper, from inside to outside, or from outside to inside;

the support table need not have a horizontal underside. It could be inclined, and flat. It could be curved, and have matching radial bars, or just annular supporting part(s).

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A pulveriser mill, comprising:

a grinding set supported upon a support table;

support framework attached to an underside of the support table, the support framework comprising an inner annular band and an outer, generally annular band interconnected through a plurality of linear bars arranged in a radial array, wherein each of the bars is secured at a first end to the inner annular band and at a second end to the outer annular band such that a plurality of openings arranged in a radial array are provided through the support table between the inner and outer annular bands; and a hub member attached to the underside of the support table and concentrically aligned with and spaced apart inward from the inner annular band;

wherein the support framework is outwardly-spaced from the hub member in a radial direction and is free of attachment to the hub member.

2. A pulveriser mill as claimed in claim 1 wherein a cross-section of the inner annular band, outer annular band, and each of the linear bars is rectangular.

* * * * *